US007472907B2

(12) United States Patent
Pomeroy

(10) Patent No.: US 7,472,907 B2
(45) Date of Patent: Jan. 6, 2009

(54) BIG BOX OFFICE "THE MOVIE BUSINESS GAME"

(76) Inventor: Andrew James Pomeroy, 5476 Kiowa Dr., #23, La Mesa, CA (US) 91942

( * ) Notice: Subject to any disclaimer, the term of this patent is extended or adjusted under 35 U.S.C. 154(b) by 195 days.

(21) Appl. No.: 11/425,216

(22) Filed: Jun. 20, 2006

(65) Prior Publication Data

US 2008/0106036 A1 May 8, 2008

(51) Int. Cl.
*A63F 3/00* (2006.01)

(52) U.S. Cl. ..... 273/244; 273/256; 273/259; 273/277

(58) Field of Classification Search ..... 273/244, 273/256, 259, 277
See application file for complete search history.

(56) References Cited

U.S. PATENT DOCUMENTS 5,472,207 A * 12/1995 Sullivan et al. ..... 273/249

6,412,777 B1 * 7/2002 Rossi ..... 273/243

* cited by examiner

*Primary Examiner*—Vishu K. Mendiratta

(57) ABSTRACT

A board game for 2 to 8 players about the movie business industry, consisting of a square playing board divided into 52 playing spaces, 12 on each side, plus 4 corner "Start Here" squares. Within the interior of the playing board are four "Theater" archways, each showing two "Film Genres." In the center of the board is the "Spinning wheel," whereby the player acquires (or loses) the movie industry titles "Producer," "Director," "Writer" or "Agent." The players begin the game by placing a game token on 1 of 4 inside corners to earn a "Salary" through dice rolls before proceeding to one of the "Start Here" squares. The players then enter the "Theater" archways after acquiring from 1 to 8 of the "Film Genre" cards and from 1 to 4 "Industry Title" rings, accumulating the pre-determined amount of money and winning the game.

1 Claim, 3 Drawing Sheets

BIG BOX OFFICE "THE MOVIE BUSINESS GAME"

This invention relates to a board game based on bringing a feature film to market in the movie business.

SUMMARY OF THE INVENTION

The principle object of this invention is to provide a board game that incorporates the four primary areas of the movie business industry, namely the contributions made by the Directors, Writers, Producers and Agents. A further object of this invention is the making of money by investing in films within the specific genres of the film industry, namely Drama, Science Fiction, Documentary, Comedy, Fantasy, Thriller, Animated Feature, and Romantic Comedy. After the player acquirers one or more of the specific colored industry rings (designating Director, Writer, Producer or Agent) the player is now able to generate various amounts of money by entering the specific theater archway that is showing that particular genre of film.

To this end, the present invention comprises a game board which is divided into 52 playing squares, 12 squares bordering each side and four Start Here squares, one in each corner of the playing surface. Along each side of the game board, connected to the main playing squares, are also 2 theater archway entry points. These entry points allow each player to generate various amounts of money from each of the 8 specific film genres being shown in that theater (2 on each side of the playing surface). As additional accessories to the game board, there are provided a pair of dice, a plurality of game tokens, a plurality of plastic colored rings for industry title designation (which are to be placed on top of the game token), a Spinning Wheel apparatus by which the player acquires (or loses) an colored industry ring and 4 decks of playing cards designated Director, Writer, Producer or Agent, which the player is sent to by landing on specific squares in the outer portion of the playing board. Other accessory pieces include simulated currency for the money making transactions occurring after a player enters the theater archway portions of the game board.

BRIEF DESCRIPTION OF DRAWINGS

In order that the invention may be readily understood, an embodiment thereof will now be described with reference to the accompanying drawings in which.

DESCRIPTION OF PREFERRED EMBODIMENT

Figure 1:
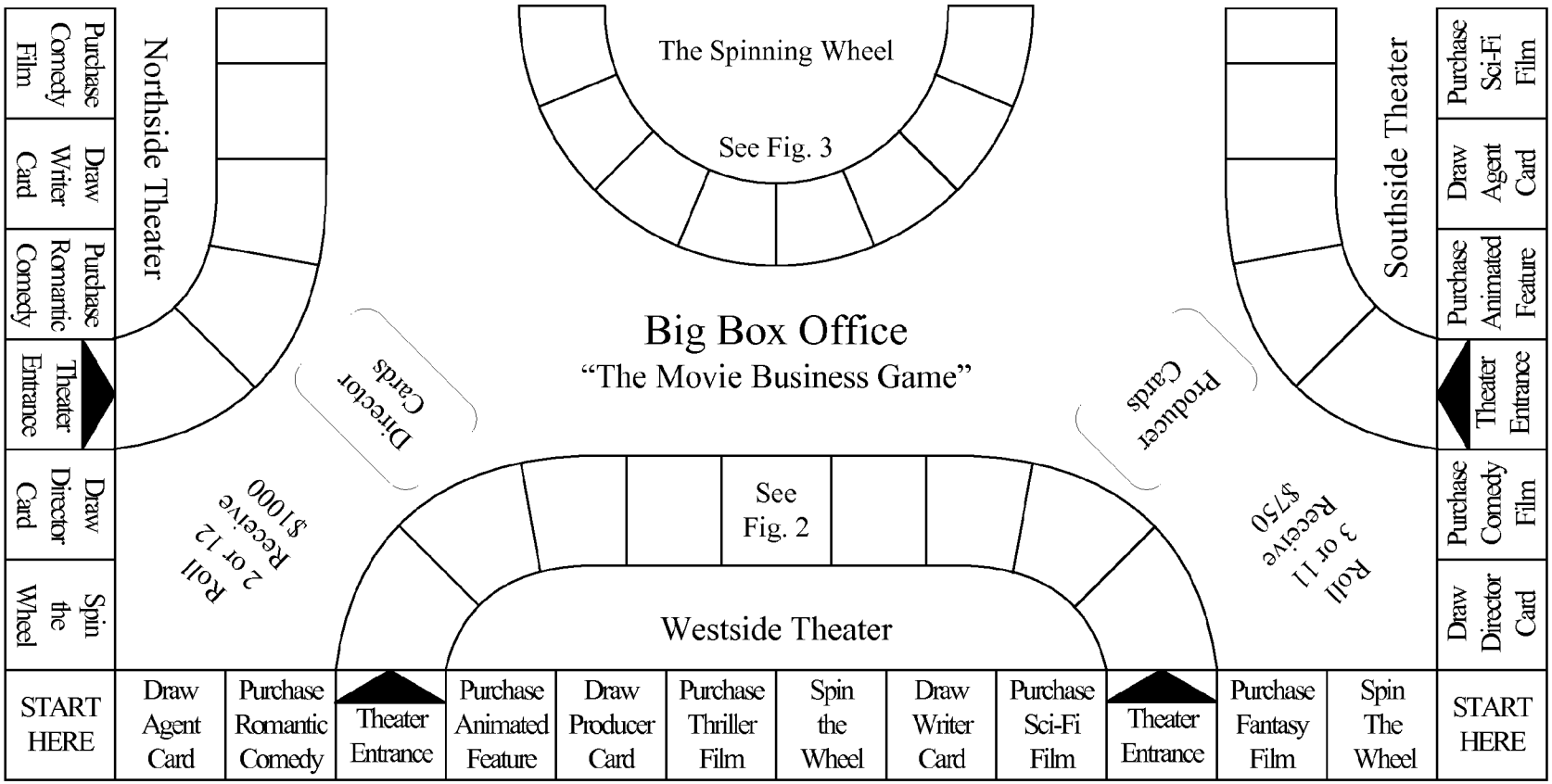
FIG. 1 is a plan view of part of the playing surface.

FIG. 1 shows half of the square playing surface, showing 2 of the 4 corner "Start Here" spaces and 26 of the 48 perimeter spaces, 12 between each of the "Start Here" spaces. Connected to these perimeter squares, the "Westside Theater" archway portion of the game is shown. Half of the "Southside Theater" and "Northside Theater" is also shown. The "Producer" and "Director" card areas are shown. The "Agent" and "Writer" card areas are not shown, but would be in the same respective areas on the other side of the playing surface. The "Work" areas labeled "Roll 2 or 12 Receive $1000" and "Roll 3 or 11 Receive $750" are shown in the interior corners of the central playing area. The other "Work" areas of "Roll 5 of 9 Receive $500" and "Roll 4 or 10 Receive $250" are not shown, but would be on the same respective areas on the other side of the playing surface. One half of the "Spinning Wheel" area is shown in the center of the playing surface.

Figure 2:
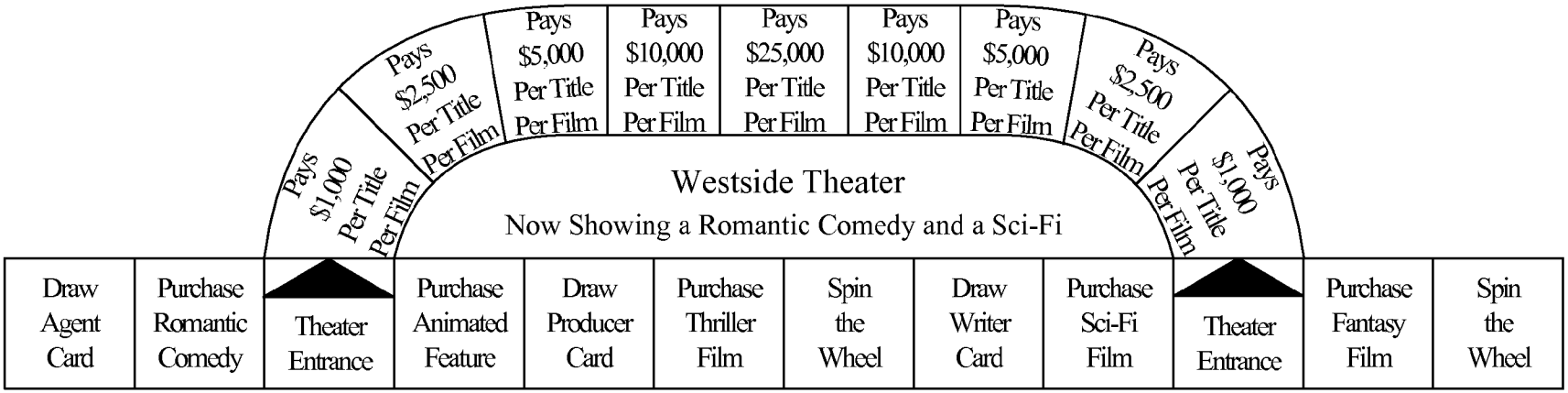
FIG. 2 is a plan view of one theater "archway" portion of the game.

FIG. 2 shows a plan view of the "Westside Theater" archway portion of the central playing area and the 9 "Film Payoff" spaces within this archway.

Figure 3:
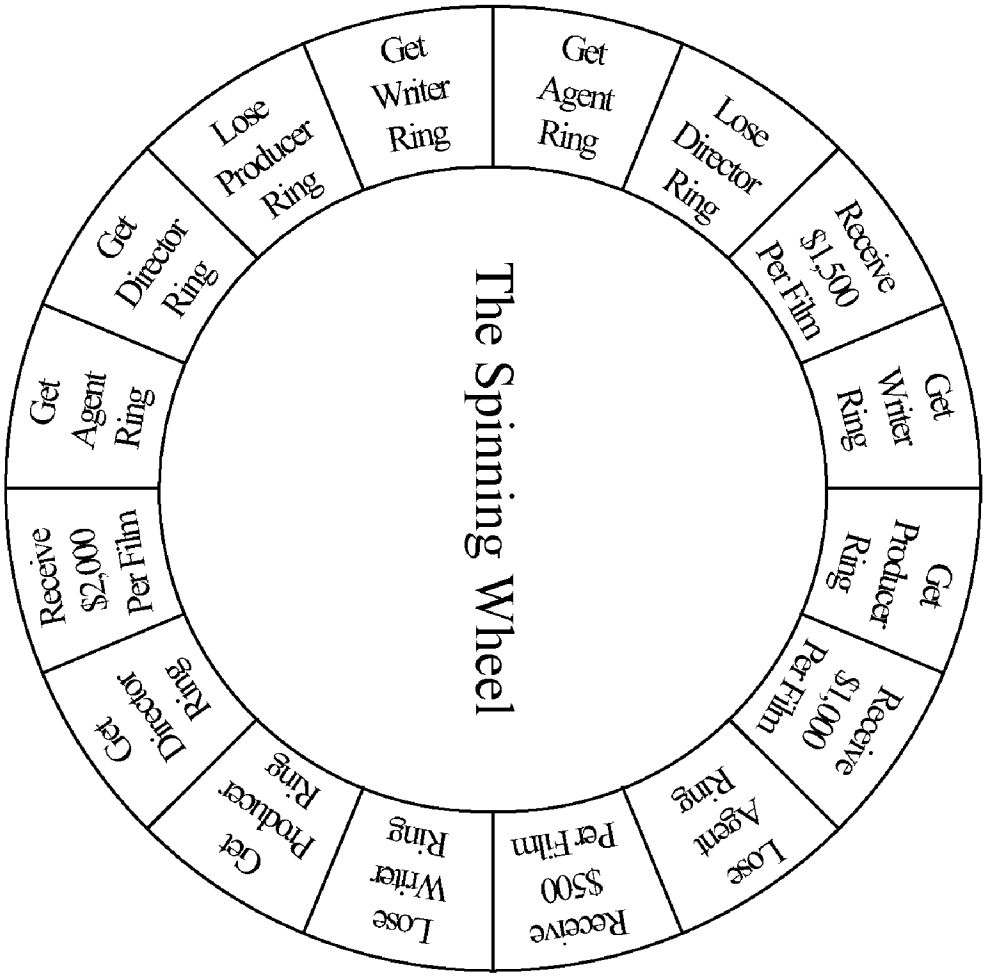
FIG. 3 is a plan view of the "spinning wheel" apparatus of the game.

FIG. 3 shows a plan view of the "Spinning Wheel" apparatus and the 16 spaces for acquiring (or losing) "Industry Title" rings within this wheel.

The rules for playing the game using the novel playing apparatus are hereinbefore described:

Equipment

Big Box Office—"The Movie Business Game" contains one playing board with a detachable "Spinning Wheel" apparatus located in the center of the playing surface. It contains 64 "Film Genre" cards, covering a maximum of 8 cards per player and 8 players playing. There 8 colored plastic tokens, 32 plastic "Industry Title" rings in 4 different colors, 120 draw cards, 30 for each of the 4 industry titles of "Producer," "Director," "Writer" and "Agent," Imitation money in denominations of $50, $100, $500, $1000, $5,000, $10,000 and $20,000. A pair of dice and printed "Rules of Play." The "Film Genre" archways are designated as "Comedy," "Drama," "Science Fiction," "Fantasy," "Documentary," "Thriller," "Animated Feature" and "Romantic Comedy." When the player acquires of an "Industry Title" ring, the player places the appropriately colored plastic ring over their playing token. Within each of the four "Theater" archways are nine "Payoff" squares with varying money payouts to players having the specific "Film Genre" card designated by the entrance square to the archway. The player must have one or more "Industry Title" rings on their token to receive any money payout within these "Theater" archways. In the center of the playing board is a spinning wheel apparatus with which the player either acquires (or loses) one or more of the four "Industry Title" rings. Surrounding the spinning wheel area on the playing surface are four decks of randomly shuffled playing cards. Each pile of cards is designated either "Producer," "Director," "Writer" or "Agent." These cards, available only to players owning that specific "Industry Title" ring, will direct the player to different locations of the playing board. The player starts the game by earning a "Salary" and placing playing their token on one of four interior "Work" area corners of playing board. Dice rolls determine varying pay amounts. Once the player accumulates $2,500, said player must leave the "Work" area and place playing token on one of four "Start Here" corner squares. Player then proceeds to accumulate "Film Genre" cards and "Industry Title" rings in order to enter the "Theater" archways and amass profits for their film or films. The first player to amass $10,000,000 wins the game.

Object of the Game

The object of the game is to build wealth by accumulating "Film Genre" Cards and "Industry Title" rings and then entering the "Theater" archways, whereby making profits on the films ("Film Genre" cards) owned.

Preparation for Play

Attach the "Spinning Wheel" apparatus to the center of the unfolded playing board. Designate one player to be "Banker" and one player to distribute "Film Genre" Cards and "Industry Title" rings. Players select colored playing token.

Start of Play

All Players place chosen playing tokens in one of the four "Work" areas located in the interior corners of the playing surface. Players then roll two dice, with the flow of play being in a clockwise (right to left) direction. When any player rolls dice resulting in one of the "Work" area payoff combinations, all players with tokens in that "Work" area receive the amount indicated from the bank. Players are free to move to any of the four "Work" areas prior to the next roll. Once any player accumulates $2,500 from the "Work" areas, said player must leave the "Work" area on his or her next roll and advance token to one of the four "Start Here" corner squares.

Continuation of Play

After the player has advanced to one of the four "Start Here" corner squares, the player then moves playing token in a clockwise (right to left) direction along the perimeter squares designated by number indicated on the two dice. Once player lands on a "Purchase Film" square, player decides to purchase or not purchase that particular "Film Genre" card. The purchase price of each film genre cards is 100 times value shown on both dice. For example, if the player rolls a 7, the price of the particular "Film Genre" card is $700. The player must then acquire one or more "Industry Title" rings in order to enter the "Theater" archway that is showing that particular film or films. Each "Theater" shows two genres of films. If the player has both films ("Film Genre" cards) that are being shown in that theater, said player can go back through the theater they entered, in the opposite direction, only if said player lands on the "Theater Entrance" square when exiting theater. Players can only own one "Film Genre" card of each of the eight film genres at any particular time.

Producer, Director, Writer and Agent Cards

"Producer," "Director," "Writer" and "Agent" Cards can only be drawn if player has acquired either a "Producer," "Director," "Writer" or "Agent" Industry Title ring by spinning the wheel. These cards will direct player to various areas of the playing surface.

Winning the Game

The first player to accumulate $10,000,000 in film profits wins the game. If all players agree, a lower total amount of film profits needed to win the game can be agreed upon prior to starting the game.

What is claimed is:

1. A board game for 2 to 8 players based on becoming a producer, director, writer or agent in the movie business industry, and thus acquiring the funding to bring a feature film to market and amass large theater profits, comprising in combination:

a square playing surface, having an outer perimeter path divided into 52 playing squares relating to the acquisition of job titles in the movie business industry, including "Producer," "Director," "Writer" and "Agent," comprised of 12 perimeter squares on each side of the playing board, plus 4 corner squares marked with "Start Here";

4 "Theater" archways, each showing two "Film Genres" on the interior of the arched playing surface, connected at both ends to two of the outer perimeter playing squares marked "Theater Entrance," wherein each "Theater" archway has 9 interior payoff squares of varying amounts depending on "Film Genre" cards and "Industry Title" rings owned by the player prior to entering the archway;

a spinning wheel apparatus having positions marked with ring designation and used for acquiring (or losing) from 1 to 4 different colored "Industry Title" rings, which are placed over the player's game token and designated "Producer," "Director," "Writer" and "Agent;"

64 "Film Genre" cards (up to eight per player with a maximum of 8 players) marked with eight genres of film, which are "Comedy," "Drama," "Science Fiction," "Fantasy," "Documentary," "Thriller," "Animated Feature" and "Romantic Comedy;"

a multiplicity of playing cards marked with "Producer," "Director," "Writer" and "Agent," advancing player to different locations on the perimeter playing squares;

a money tray containing imitation money in the denominations of $100, $500, $1000, $5000, $10,000, $20,000 and $50,000;

8 different colored plastic playing tokens, each large enough to hold up to four plastic "Industry Title" rings, such as "Producer," "Director," "Writer" and "Agent;"

32 colored plastic "Industry Title" rings (up to four per player with a maximum of 8 players) in four different colors with each color corresponding to a different film industry title, including "Producer," "Director," "Writer" and "Agent;" which are placed over each player's token;

a pair of dice; and a set of printed rules prescribing that the first player to accumulate $10,000,000 in theater profits will be the winner of the game.

* * * * *